US009206688B2

(12) United States Patent
Landrum

(10) Patent No.: US 9,206,688 B2
(45) Date of Patent: Dec. 8, 2015

(54) HIGH TORQUE ROTARY MOTOR WITH MULTI-LOBED RING WITH INLET AND OUTLET

(71) Applicant: SPX Corporation, Charlotte, NC (US)

(72) Inventor: Michael T. Landrum, Rockford, IL (US)

(73) Assignee: SPX FLOW, INC., Charlotte, NC (US)

( * ) Notice: Subject to any disclaimer, the term of this patent is extended or adjusted under 35 U.S.C. 154(b) by 128 days.

(21) Appl. No.: 13/938,563

(22) Filed: Jul. 10, 2013

(65) Prior Publication Data

US 2015/0017042 A1 Jan. 15, 2015

(51) Int. Cl.

| | |
|---|---|
| ***F01C 1/344*** | (2006.01) |
| ***F01C 21/08*** | (2006.01) |
| ***F03C 2/30*** | (2006.01) |

(52) U.S. Cl.

CPC ..... *F01C 1/344* (2013.01); *F01C 21/0836* (2013.01); *F01C 21/0881* (2013.01); *F03C 2/304* (2013.01); *Y10T 29/49245* (2015.01)

(58) Field of Classification Search

CPC ..... F01C 1/344; F01C 21/106; F04C 2/344; F04C 18/344; F03C 2/304

See application file for complete search history.

(56) References Cited

U.S. PATENT DOCUMENTS

| | | | | |
|---|---|---|---|---|
| 552,992 | A | 1/1896 | Evans, Jr. | |
| 705,835 | A | 7/1902 | Grove | |
| 1,142,544 | A | 6/1915 | Vernon et al. | |
| 2,521,595 | A * | 9/1950 | Miller | 418/111 |
| 3,230,840 | A * | 1/1966 | Hanson | 418/238 |
| 3,590,875 | A * | 7/1971 | Northcutt | 137/630.14 |
| 3,799,706 | A * | 3/1974 | Bilobran | 418/61.2 |
| 6,857,864 | B2 * | 2/2005 | Kettner | 418/266 |
| 7,273,360 | B2 | 9/2007 | Shinoda et al. | |
| 8,156,919 | B2 | 4/2012 | Darrow | |
| 2012/0031370 | A1 * | 2/2012 | Guenther | 123/243 |

(Continued)

FOREIGN PATENT DOCUMENTS

| | | |
|---|---|---|
| CH | 578677 | 8/1976 |
| DE | 612784 | 5/1935 |

(Continued)

OTHER PUBLICATIONS

Dutch Search Report issued in Dutch Patent Application No. 2013159, mailed on Jul. 28, 2015.

(Continued)

*Primary Examiner* — Mary A Davis
(74) *Attorney, Agent, or Firm* — Baker & Hostetler LLP

(57) ABSTRACT

The present invention relates to a rotary motor, comprising a plurality of vanes, an inner rotary member housing the plurality of vanes projecting from a central rotation axis of the inner rotor, a multi lobe member encompassing the inner rotary member and the plurality of vanes, where the multi lobe member comprises at least two lobes wherein each of the lobes comprises an inlet and an outlet for a working medium, and a plurality of chambers wherein each of the chambers is encompassed by an inner surface of the multi lobe member and an outer surface of the inner rotary member. Such devices in accordance with some embodiments of the invention provide that a plurality of inlets and outlets amplify the output torque of the motor, that any side load is absent or minimized, and that a faster and stronger rotational force is achieved compared to a conventional hydraulic motor having a single pair of inlet and outlet.

38 Claims, 8 Drawing Sheets

(56) References Cited

U.S. PATENT DOCUMENTS

| | | | | |
|---|---|---|---|---|
| 2013/0340707 | A1* | 12/2013 | Garcia Rodriguez | 123/241 |
| 2015/0017050 | A1* | 1/2015 | Landrum | 418/263 |

FOREIGN PATENT DOCUMENTS

| | | | |
|---|---|---|---|
| DE | 2528019 | A1 * | 1/1976 |
| DE | 2952640 | | 7/1981 |
| DE | 29620604 | | 3/1997 |
| FR | 733731 | A * | 10/1932 |
| FR | 2217987 | | 9/1974 |
| FR | 2885644 | A1 * | 11/2006 |
| FR | 2944832 | | 10/2010 |

OTHER PUBLICATIONS

Dutch Search Report issued in Dutch Patent Application No. 2013159, mailed on Aug. 7, 2015.

* cited by examiner

HIGH TORQUE ROTARY MOTOR WITH MULTI-LOBED RING WITH INLET AND OUTLET

FIELD OF THE INVENTION

The invention relates to a rotary power motor, particularly to a rotary power motor equipped with a multi lobe motor ring and the manufacturing method thereof.

BACKGROUND OF THE INVENTION

A conventional hydraulic rotary motor is typically manufactured in a way that vanes project from a rotor and rotate about a central axis of rotation. The motor includes housing where the vanes and the housing define a plurality of chambers. The motor typically has a single inlet for a working medium to enter the plurality of chambers and a single outlet for the working medium to exit the plurality of chambers where the torque to rotate the rotor is limited by the single pair of inlet and outlet.

The rotor in the conventional hydraulic rotary motor is designed to move in directions perpendicular to the central axis of rotation. A volume of each of the chambers in relation to an angular position of the chamber varies as the rotor moves in directions perpendicular to the central rotation axis during rotation of the rotor. In particular, the volume of a chamber is at its minimum and the pressure of the working medium in the chamber is at maximum as the chamber rotates past the inlet. The volume of the chamber increases and the pressure in the chamber decreases as the chamber approaches the outlet. Such a movable rotor induces uneven pressure loading and thus a severe side load to a shaft supporting the rotor. Additionally, the torque acting on each vane is not consistent during rotation of the rotor. Accordingly, it would be desirable to have a motor that addresses some of the issues described above.

BRIEF SUMMARY OF THE INVENTION

In one aspect, there is provided a rotary motor, the rotary motor including: a plurality of vanes; an inner rotary member housing the plurality of vanes projecting from a central rotation axis of the inner rotor; a multi lobe member encompassing the inner rotary member and the plurality of vanes, wherein the multi lobe member includes at least two lobes wherein each of the lobes includes an inlet and an outlet for a working medium; and a plurality of chambers, wherein each of the chambers is encompassed by an inner surface of the multi lobe member and an outer surface of the inner rotary member.

In another aspect, there is provided a rotary motor, the rotary motor including: an inner rotary member; a plurality of end plates; a multi lobe member including 2 or more lobes wherein each of the lobes includes an inlet and an outlet for a working medium, wherein the working medium comprises a gas, air, fluid or a combination thereof, wherein the working medium entering the inlet port of the outer port member is pressurized, and wherein a compression ratio of the working medium is adjustable; and a plurality of vanes wherein a number of the vanes is larger than a number of the lobes.

In another aspect, there is provided a method for manufacturing a rotary motor, the method including: placing a plurality of vanes in an outer circumferential surface of an inner rotary member; forming a plurality of lobes each of which includes an inlet and an outlet; circumferentially arranging the lobes in an inner circumferential surface of a multi lobe member; configuring the lobes to form a contact with the outer circumferential surface of the inner rotary member; encompassing the plurality of vanes and the inner rotary member with the multi lobe member including an inlet groove and an outlet groove on an outer surface of the multi lobe member; forming a plurality of chambers wherein each chamber is placed between two adjacent lobes and is encompassed by the inner circumferential surface of the multi lobe member and the outer circumferential surface of the inner rotary member; encompassing the multi lobe member with an outer port member including an inlet port and an outlet port; and covering and sealing sides of the outer port member, the multi lobe member, the inner rotary member and the chambers with a plurality of end plates.

In still another aspect, there is provided an apparatus for use in a hydraulic torque system, the apparatus including: rotating means for housing a plurality of torque generating means; means for supplying a working medium to act on the torque generating means wherein the means for supplying the working medium includes two or more contacting portions, wherein each of the contacting portions includes an inlet and an outlet for the working medium, and wherein each of the contacting portions is in contact with at least one of an inner circumferential surface of the rotating means and the torque generating means; a plurality of means for holding the working medium, wherein each of the plurality of the means for holding the working medium is encompassed by an inner surface of the means for supplying the working medium and an outer surface of the rotating means, wherein the means for holding the working medium is placed between two contacting portions, and wherein each of the plurality of means for holding the working medium is configured to maintain an equal volume during rotation of the rotating means; means for enclosing the means for supplying the working medium; and means for covering and sealing the means for supplying the working medium and the rotating means.

There has thus been outlined, rather broadly, certain aspects of the invention in order that the detailed description thereof herein may be better understood, and in order that the present contribution to the art may be better appreciated. There are, of course, additional aspects of the invention that will be described below and which will form the subject matter of the claims appended hereto.

In this respect, before explaining at least one aspect of the invention in detail, it is to be understood that the invention is not limited in its application to the details of construction and to the arrangements of the components set forth in the following description or illustrated in the drawings. The invention is capable of aspects in addition to those described and of being practiced and carried out in various ways. Also, it is to be understood that the phraseology and terminology employed herein, as well as the abstract, are for the purpose of description and should not be regarded as limiting.

DETAILED DESCRIPTION OF THE INVENTION

Figure 1:
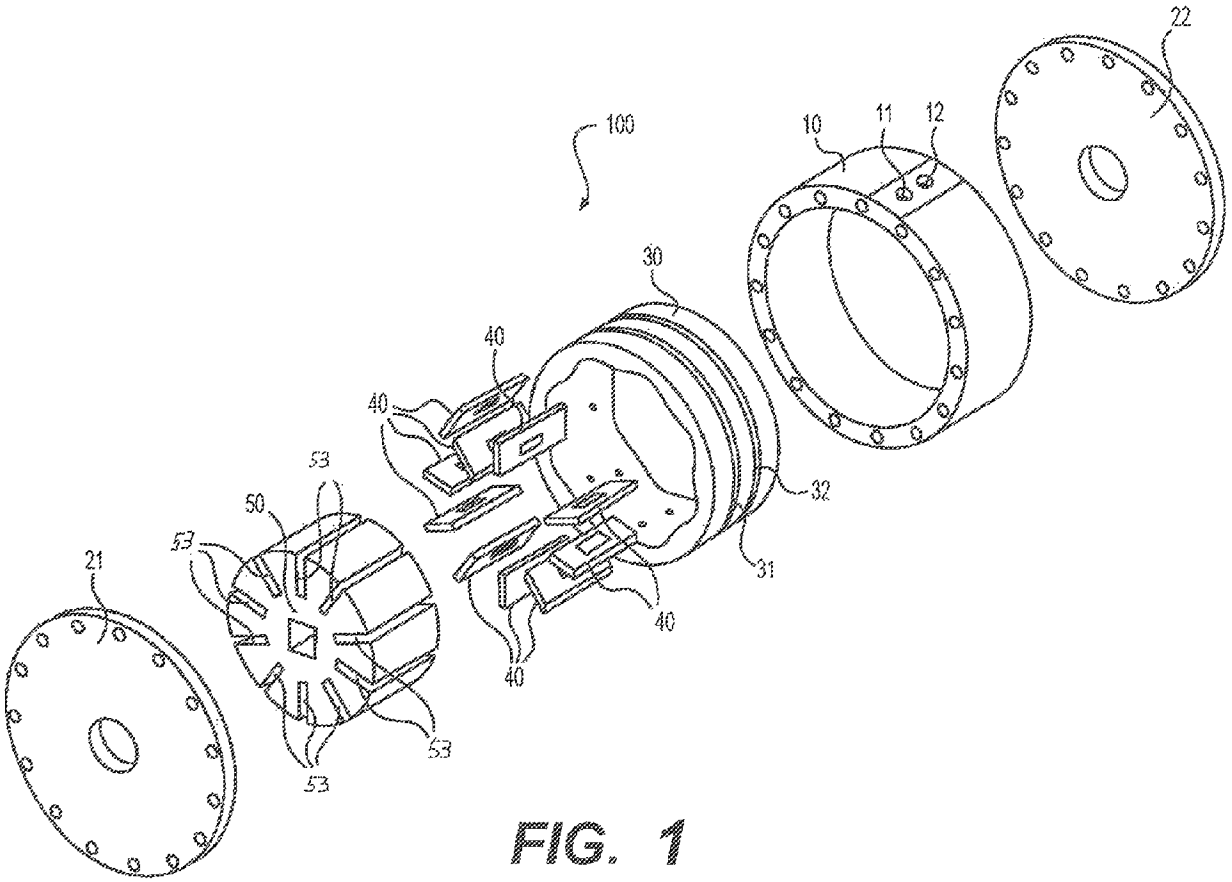
FIG. 1 depicts an exploded view of an exemplary rotary medium power motor according to the disclosure.

The invention will now be described with reference to the drawing figures, in which like reference numerals refer to like parts throughout. An embodiment in accordance with the present invention provides a rotary power motor. Such devices in accordance with some embodiments of the invention provide that a plurality of inlets and outlets amplify the output torque of the motor, that any side load is absent or minimized, and that a faster and stronger rotational force is achieved compared to a conventional hydraulic motor having a single pair of inlet and outlet.

FIG. 1 depicts an exploded view of an exemplary rotary power motor according to the disclosure. The rotary power motor 100 may include one or more end plates 21, 22, an outer port ring 10, a multi lobe motor ring 30, a plurality of vanes 40, and an inner rotor 50. Each of the plurality of vanes 40 may be housed in the corresponding vane slot 53 in the inner rotor 50. The outer port ring 10 may include an inlet port 11 and an outlet port 12. The outer port ring 10 may circumferentially enclose the multi lobe motor ring 30. The multi lobe motor ring 30 may include an inlet flow groove 31 and an outlet flow groove 32 on an outer surface of the multi lobe motor ring 30. The multi lobe motor ring 30 may circumferentially enclose the plurality of vanes 40 and the inner rotor 50. The front and rear end plates 21, 22 may be placed on the sides of the plurality of vanes 40, the inner rotor 50, the multi lobe motor ring 30 and the outer port ring 10.

In one aspect, a working medium entering the inlet port 11 of the outer port ring 10 may be received by the inlet flow groove 31 on the outer circumferential surface of the multi lobe motor ring 30. The working medium on the outlet flow groove 32 may be discharged by way of the outlet port 12. The working medium entering the inlet port 11 may be pressurized. In some aspects, the working medium may include air, fluid, gas, or a combination thereof. In various aspects, a compression ratio of the working medium may be adjustable, depending on the desired speed of the motor 100, the kind of the working medium, and the operating conditions of the motor 100.

Figure 2:
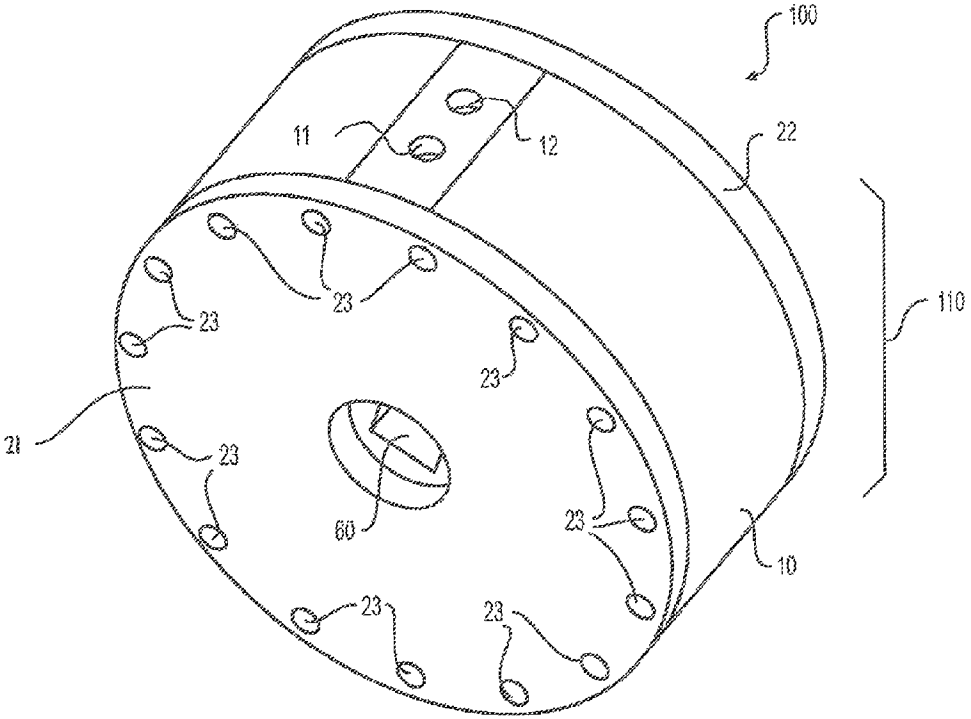
FIG. 2 depicts a perspective view of the exemplary rotary medium power motor according to the disclosure.

FIG. 2 depicts a perspective view of the exemplary rotary power motor according to the disclosure. The rotary power motor 100 may include a cylindrical housing 110 that includes the outer port ring 10 forming a circumferential surface of the cylindrical housing 110. Each of front and rear end plates 21, 22 may be secured to a side of the outer port ring 10 to close the cylindrical housing 110 by a plurality of circumferentially spaced fastening members 23 such as nuts, screws, or the like.

The rotary power motor 100 may further include a drive 60. The drive 60 may pass through a central axis of the front and rear end plates, 21, 22 and the outer port ring 10. In one aspect, the drive 60 may not move in a direction perpendicular to the central axis during operation of the motor 100.

The outer port ring 10 may include one or more inlet and outlet ports 11, 12. In one aspect, the outer port ring 10 may include a single pair of inlet port 11 and outlet port 12 on a circumferential surface of the outer port ring 10. A working medium may enter into the rotary power motor 100 by way of the inlet port 11 and may be discharged by way of the outlet port 12. The outer port ring 10 may circumferentially enclose the multi lobe motor ring 30 (see FIG. 3).

Figure 3:
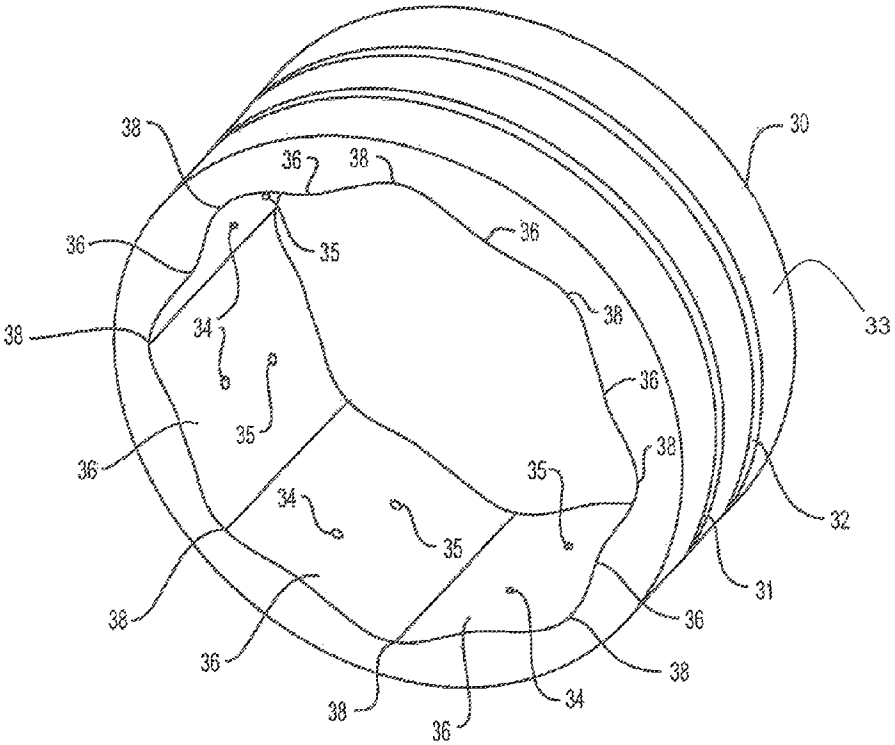
FIG. 3 depicts a perspective view of the multi lobe motor ring 30.

FIG. 3 depicts a perspective view of the multi lobe motor ring 30. An outer circumferential surface 33 of the multi lobe motor ring 30 may include one or more of pairs of inlet flow groove 31 and outlet flow groove 32. The inlet flow groove 31 may be aligned with the inlet port 11 of the outer port ring 10 (see FIG. 2) so that the inlet flow groove 31 can receive the working medium from the inlet port 11. Similarly, the outlet flow groove 32 may be aligned with the outlet port 12 of the outer port ring 10 (see FIG. 2) so that the medium flowing in the outlet flow groove 32 may be discharged by way of the outlet port 12.

The multi lobe motor ring 30 may include a plurality of lobes 36. In one aspect, a number of the lobes 36 may be 2 or more, preferably, 6 or more. Optionally, a number of the lobes 36 may be 8 or more. Each of the plurality of lobes 36 may include a pair of inlet 34 and outlet 35. In one aspect, the inlet 34 and the outlet 35 in the pair may be positioned parallel to each other in a width direction of the multi lobe motor ring 30. In some aspects, the inlet 34 and the outlet 35 in the pair may be aligned at an angle with respect to the width direction of the multi lobe motor ring 30. The plurality of lobes 36 may be placed in an inner circumferential surface of the multi lobe motor ring 30. In one aspect, the plurality of lobes 36 may be periodically spaced at equal distances along the inner circumferential surface of the multi lobe motor ring 36.

Each lobe of the plurality of lobes 36 may be positioned at a planar or convex position of the inner circumferential surface of the multi lobe motor ring 30 where a concave working chamber 38 may be formed between two adjacent lobes 36. In one aspect, the inlets 34 at the plurality of lobes 36 may be aligned with the inlet flow groove 31 so that each of the inlets 34 can receive the working medium from the inlet flow groove 31 and introduce the working medium to the corresponding concave working chamber 38. Similarly, the outlets 35 at the plurality of lobes 36 may be aligned with the outlet flow groove 32 so that the outlet flow groove 32 can receive the working medium exiting the concave working chambers 38 by way of the outlets 35. Due to the continuous medium flow loop among the outer port ring 10, the multi lobe motor ring 30, and the chambers 38, the rotary medium power motor 100 may produce higher torque compared to a conventional hydraulic motor.

Figure 4:
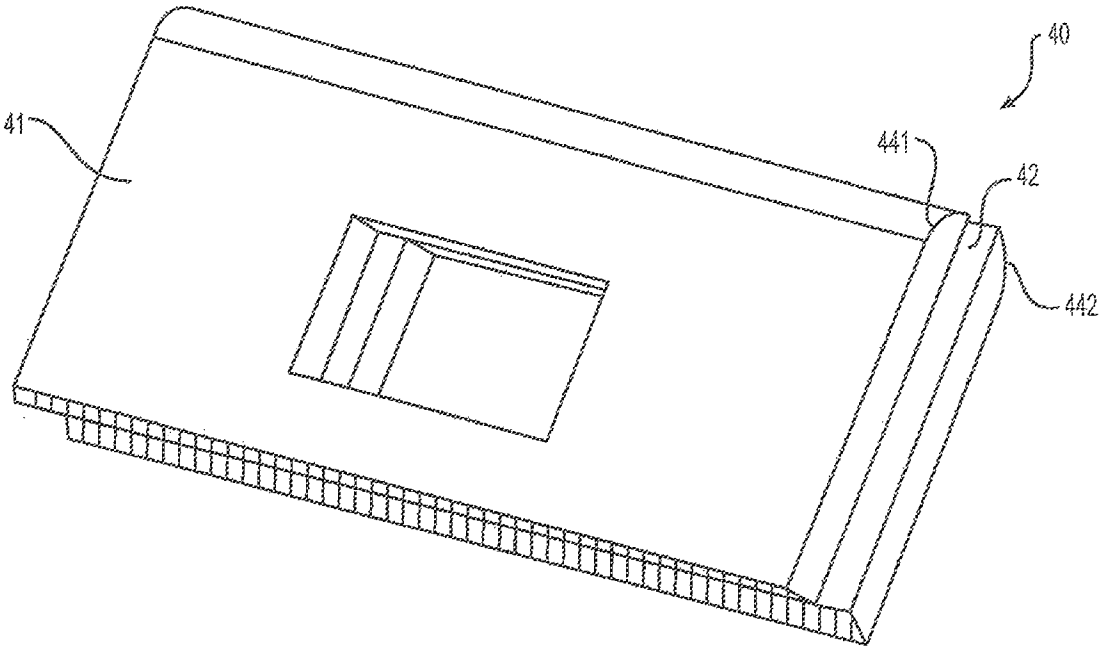
FIG. 4 depicts a perspective view of a vane 40.

FIG. 4 depicts a perspective view of a vane 40. The vane 40 may include one or more subvanes 41, 42. In one aspect, the vane 40 may be split into a pair of subvanes, first 41 and second 42 subvanes where the pair of first 41 and second 42 subvanes can slide with respect to each other while remaining, in part, in contact with each other. In one aspect, the vane 40 may have a rectangular shape. A side end 441, 442 of each of the first 41 and second 42 subvanes may be rounded. The other side end of each of the first 41 and second 42 subvanes may have an angular shape. The round shapes 441, 442 of the vane 40 may be in contact with the inner circumferential surface of the multi lobe motor ring 30 (see FIG. 1), thereby forming a seal between the vane 40 and the inner circumferential surface of the multi lobe motor ring 30 during rotation of the inner rotor 50 (see FIG. 1). The round shapes 441, 442 of the vane 40 may reduce a frictional force between the vane 40 and the inner circumferential surface of the multi lobe motor ring 30 while enabling the vane 40 to maintain a contact with the inner circumferential surface of the multi lobe motor ring 30 during rotation of the inner rotor 50. In some aspect, a number of vanes 40 may be larger than a number of lobes 36 to prevent bypass flow of the working medium.

Figure 5:
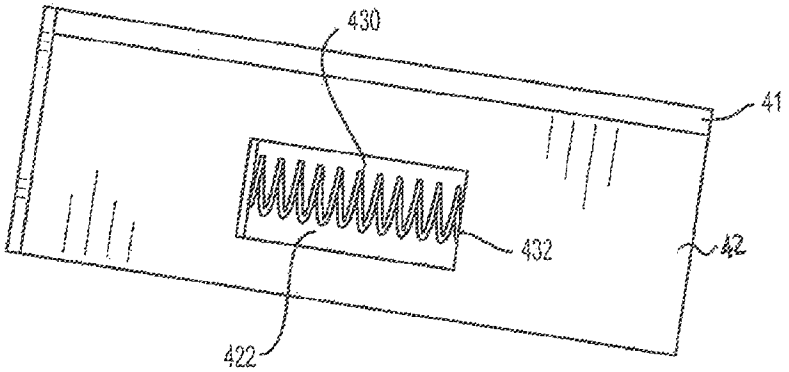
FIG. 5 depicts a top view of a vane 40 having a coil spring.
Figure 6:
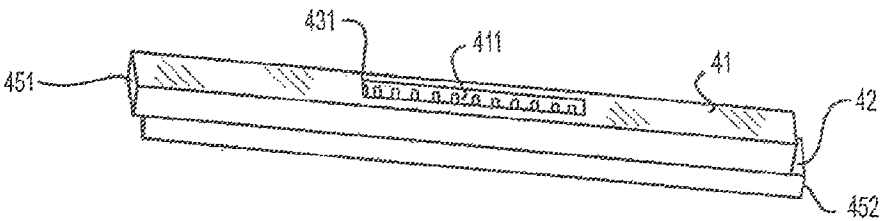
FIG. 6 depicts a perspective view of the vane in FIG. 5.

FIG. 5 depicts a top view of a vane 40 having a coil spring and FIG. 6 depicts the corresponding perspective view. Each of the first 41 and second 42 subvanes may include an offset slot 411, 422 in the interior of the subvane where an elastic member 430 can be placed in the offset slots 411, 422. The elastic member 430 may include a spring. In some aspects, the elastic member 430 may include a coil spring, a flat spring or the like. While the first 41 and second 42 subvanes may remain, in part, in contact with each other, one end 431 of the coil spring 430 may be in contact with a surface of the offset slot 411 in the first subvane 41, thereby pushing the end 451 of the first subvane 41 forward. Resultantly, the end 451 of the first subvane 41 may form a contact with an inner surface of the first end plate 21 (see FIG. 1), thereby forming a seal between the vane 40 and the first end plate 21. Similarly, the other end 432 of the coil spring 430 may be in contact with a surface of the offset slot 422 in the second subvane 42, thereby pushing the end 452 of the second subvane 42 to the opposite direction to the forwarded first subvane 41. Resultantly, the end 452 of the second subvane 42 may form a contact with an inner surface of the second end plate 22 (see FIG. 1), thereby forming a seal between the vane 40 and the second end plate 22. This type of split vane design may allow the vanes to force a seal to the end plates 21, 22 so that the motor 100 can work at much higher medium pressures compared to a conventional vane motor.

Figure 7:
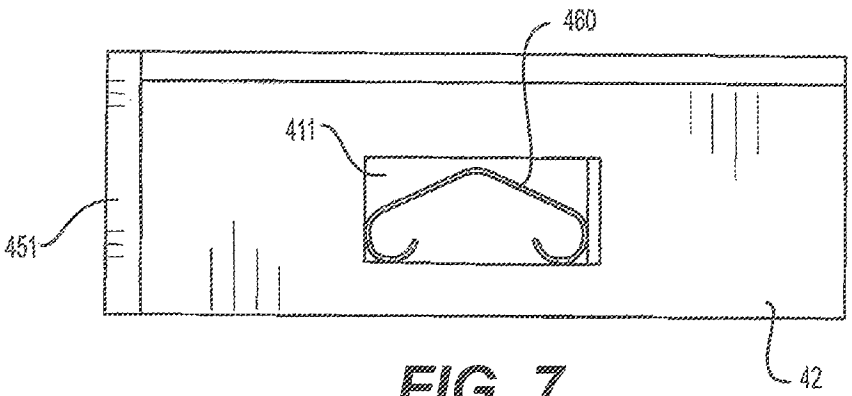
FIG. 7 depicts a top view of a vane 40 having a flat spring.
Figure 8:
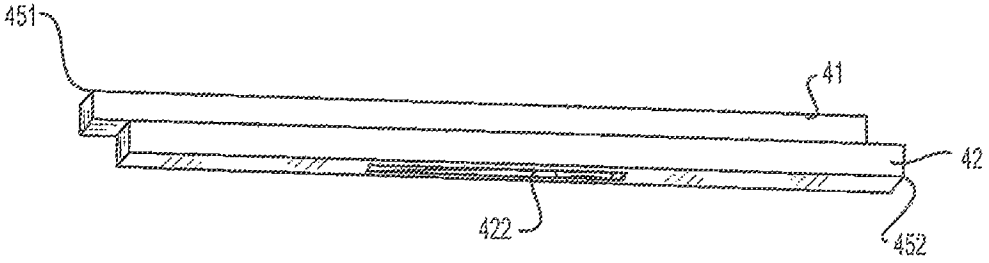
FIG. 8 depicts a perspective view of the vane in FIG. 7.

FIG. 7 depicts a top view of a vane 40 having a flat spring and FIG. 8 depicts the corresponding perspective view where the flat spring 460 is placed in the offset slots 411, 422. Similar to the coil spring 430 in FIGS. 5-6, while the first 41 and second 42 subvanes may remain, in part, in contact with each other, the end 451 of the first subvane 41 is pushed forward, thereby forming a seal between the first subvane 41 and the first end plate 21. The end 452 of the second subvane 42 forms a seal between the second subvane 42 and the second end plate 22.

Figure 9:
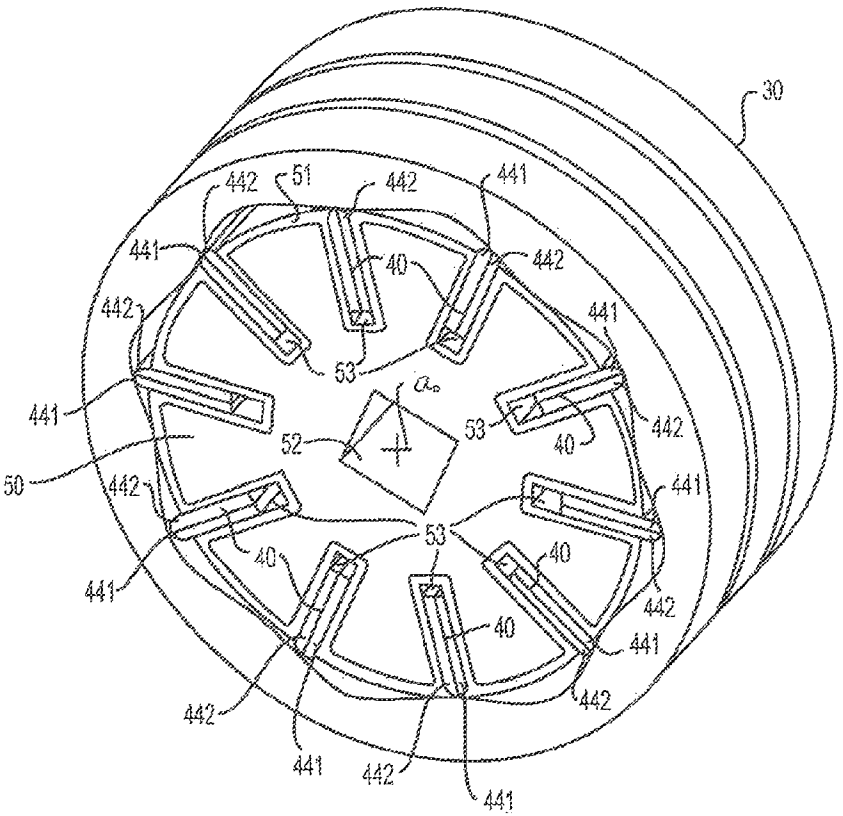
FIG. 9 depicts a perspective view of the multi lobe motor ring 30, the plurality of vanes 40 and the inner rotor 50.

FIG. 9 depicts a perspective view of the multi lobe motor ring 30, the plurality of vanes 40 and the inner rotor 50. The multi lobe motor ring 30 may enclose the plurality of vanes 40 and the inner rotor 50. The inner rotor 50 may include a plurality of vane slots 53 to house the plurality of vanes 40. The plurality of the vane slots 53 may be circumferentially arranged at equal angular intervals in the outer surface of the inner rotor 50. Each vane 40 may be positioned within the corresponding vane slot 53 in a direction perpendicular to a central rotation axis $a_0$ of the inner rotor 50. During rotation of the inner rotor 50 about the central axis $a_0$ of the inner rotor 50, fluid pressure may cause the vane 40 to slide outwardly so that the rounded sides 441, 442 of the vane 40 can be forced outside the vane slot 53 and form a contact with the inner circumferential surface of the multi lobe motor ring 30. In one aspect, the vane slot 53 may not require an expansion member to push the vane 40 outwardly to have the vane 40 in contact with the inner circumferential surface of the multi lobe motor ring 30. Alternatively, the vane slot 53 may include an expansion member to augment the outwardly-acting centrifugal force. The expansion member may include a spring, a compressed gas or any other suitable means to augment the outwardly-acting centrifugal force.

The inner rotor 50 may include one or more sealing ridges 51. The sealing ridge 51 may be placed between a side of the inner rotor 50 and the end plates 21, 22 (see FIG. 1). The sealing ridge 51 may form a seal between the inner rotor 50 and the end plates 21, 22 and reduce the pressurized area against the end plates. The inner rotor 50 may further include a drive slot 52. The drive slot 52 may hold the drive 60 (see FIG. 2) passing through the inner rotor 50. Optionally, the drive 60 may be connected to the drive slot 52. In one aspect, the central rotation axis $a_0$ of the inner rotor 50 may be aligned with the passing direction of the drive 60. In some aspects, the inner rotor 50 may not move in a direction perpendicular to the central rotation axis during rotation of the inner rotor 50.

Figure 10:
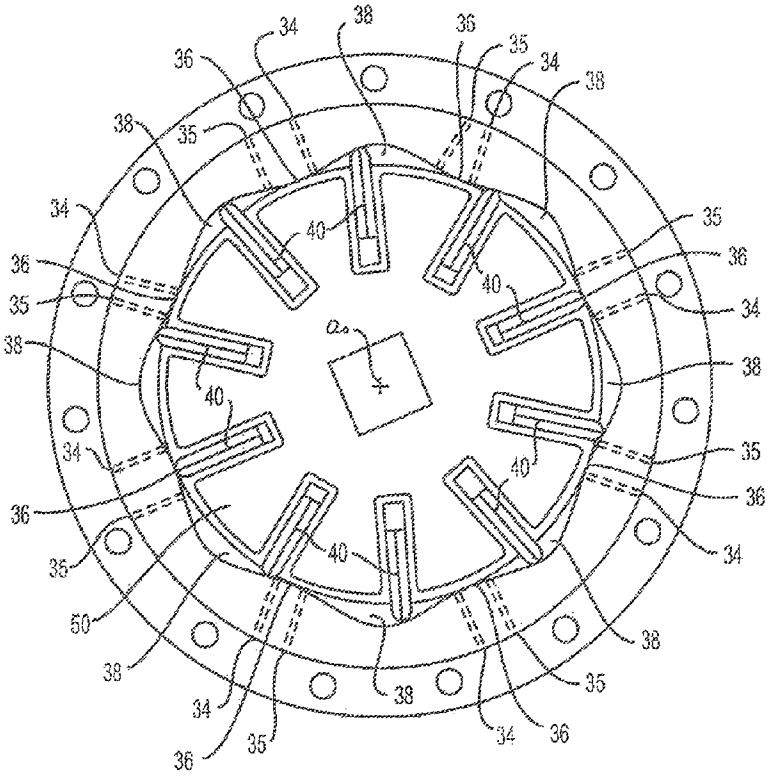
FIG. 10 depicts an end view of the multi lobe motor ring 30, the plurality of vanes 40, and the inner rotor 50.

FIG. 10 depicts an end view of the multi lobe motor ring 30, the plurality of vanes 40, and the inner rotor 50. The multi lobe motor ring 30 may enclose the plurality of vanes 40 and the inner rotor 50. The inner circumferential surface of the multi lobe motor ring 30 may include the plurality of lobes 36. The inner circumferential surface of the multi lobe motor ring 30, the outer circumferential surface of inner rotor 50 and the end plates 21, 22 (see FIG. 1) may form a plurality of working chambers 38. In one aspect, each chamber 38 may be formed by two adjacent lobes 36, the inner circumferential surface of the multi lobe motor ring 30 and the outer circumferential surface of inner rotor 50 where the chamber is closed by two end plates 21, 22.

Each chamber 38 may have an equal volume with respect to each other. In some aspects, the rotation axis $a_0$ of the inner rotor 50 may be fixed so that each chamber 38 may maintain the equal volume during rotation of the inner rotor 50. The working medium entering the inlet port 11 of the outer port ring 10 (see FIG. 1) may be received by the inlet flow groove 31 (see FIG. 1) on the outer circumferential surface of the multi lobe motor ring 30. The working medium on the inlet flow groove 31 may enter each chamber 38 by way of the inlet 34 in each lobe 36 and act on a vane 40 projecting from the inner rotor 50 to generate a torque, thereby rotating the inner rotor 50 in a clockwise or counter clockwise direction about the central rotation axis $a_0$ of inner rotor 50. Similarly, the working medium may exit the chamber 38 by way of the outlet 35 and may be subsequently discharged by way of the outlet groove 32 and the outlet port 12 of the outer port ring 10 (see FIG. 1). The medium flow path according to the disclosure may allow the working medium to feed all of the inlets and outlets in the plurality of lobes 36 without requiring multiple external connections. In addition, this type of medium flow path may allow the rotation of the rotor 50 reversible without removing and repositioning the motor 100.

Figure 11:
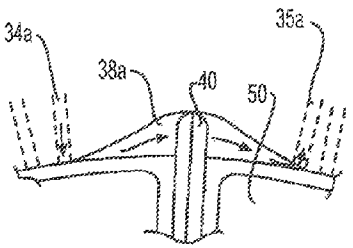
FIG. 11 depicts a portion of an exemplary chamber 38.

FIG. 11 depicts a portion of an exemplary chamber 38. The working medium entering the working chamber **38*a* by way of inlet 34*a* may act on the vane 40 projecting from the inner rotor 50, thereby rotating the inner rotor 50 as indicated by the arrow. After rotating the inner rotor 50, the working medium may exit the chamber 38*a* by way of outlet 35*a*. In one aspect, a working chamber may include an inlet and an outlet. In some aspects, a working chamber may receive a working medium by way of an inlet and discharge the working medium by way of an outlet that may be located in the nearest neighboring lobe in the rotation direction of the inner rotor 50. In various aspects, a working chamber may receive a working medium by way of an inlet and discharge the working medium by way of an outlet that may be located in the nearest neighboring lobe in the clockwise rotation direction of the inner rotor 50**.

Each chamber may produce an equal amount of torque acting on the vanes 40. The plurality of lobes including inlets 34 and outlets 35 may generate a torque arm at each of the plurality of the vanes 40. In one aspect, the torque rotating the motor 100 may be multiplied by the number of lobes 36. In various aspects, the rotary power motor 100 may need no side load and no secondary nut runner. In some aspects, all the input energy may be turned into continuous rotation and thus may achieve a faster and stronger rotational force compared to a conventional hydraulic motor.

The many features and advantages of the invention are apparent from the detailed specification, and, thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and, accordingly, all suitable modifications and equivalents may be resorted to that fall within the scope of the invention.

I claim:

1. A rotary motor, comprising:

a plurality of vanes to generate torque for the rotary motor;

an inner rotary member housing the plurality of vanes projecting from a central rotation axis of the inner rotary member;

a multi lobe member surrounding, at least in part, the inner rotary member and the plurality of vanes, wherein the multi lobe member comprises at least two lobes wherein each of the lobes comprises an inlet and an outlet;

a plurality of chambers wherein each of the chambers is surrounded, at least in part, by an inner surface of the multi lobe member and an outer surface of the inner rotary member; and an outer port member, wherein the outer port member surrounds, at least in part, the multi lobe member, wherein the outer port member comprises an inlet port and an outlet port, wherein the multi lobe member comprises an inlet groove and an outlet groove on an outer circumferential surface of the multi lobe member.

2. The rotary motor according to claim 1, wherein a number of the vanes is larger than a number of the lobes.

3. The rotary motor according to claim 1, wherein a number of the lobes is more than two.

4. The rotary motor according to claim 3, wherein a number of lobes is at least eight.

5. The rotary motor according to claim 1, wherein the net port is aligned with the inlet groove; the outlet port is aligned with the outlet groove.

6. The rotary motor according to claim 1, wherein the inlet groove is configured to receive a working fluid entering the multi lobe member by way of the inlet port; the outlet groove is configured to discharge the working fluid by way of the outlet port.

7. The rotary motor according to claim 1, wherein the inlets of the lobes are aligned with the inlet groove; the outlets of the lobes are aligned with the outlet groove.

8. The rotary motor according to claim 1, further comprising:

one or more end plates, wherein the chambers are covered, at least in part, by the end plates; each of the chambers is located between two adjacent lobes.

9. The rotary motor according to claim 1, wherein each of the chambers is configured to maintain a substantially equal volume with respect to each other during rotation of the inner rotary member.

10. The rotary motor according to claim 1, wherein each of the lobes is located in a convex portion of the inner surface of the multi lobe member.

11. The rotary motor according to claim 1, wherein a rotation axis of the inner rotary member is configured to remain stationary during rotation of the inner rotary member.

12. The rotary motor according to claim 1, wherein each of the chambers is configured to receive a working fluid by way of an inlet located in a nearest neighboring lobe of the each of the chambers and to discharge the working fluid by way of an outlet located in another nearest neighboring lobe of the each of the chambers in a rotation direction of the inner rotary member.

13. The rotary motor according to claim 1, wherein the rotary motor is configured to process a working fluid.

14. The rotary motor according to claim 13, wherein the the plurality of vanes are configured to receive the working fluid via the multi lobe member.

15. The rotary motor according to claim 14, wherein a speed of the rotary motor depends on a compression ratio of the working fluid.

16. The rotary motor according to claim 1, further comprising:

a drive passing through a central axis of the inner rotary member.

17. The rotary motor according to claim 1, at least one of the plurality of vanes is configured to maintain at least in part a contact with at least one of the plurality of chambers during rotation of the inner rotary member.

18. The rotary motor according to claim 1, further comprising:

a sealing ridge on a side of the inner rotary member.

19. The rotary motor according to claim 1, wherein the rotary motor is configured to feed a working fluid into all of the inlets and the outlets through the lobes without requiring multiple external connections.

20. The rotary motor according to claim 1, where the rotary motor is configured to allow rotation of the inner rotary member reversible without repositioning the rotary motor.

21. The rotary motor according to claim 1, wherein each of the chambers is configured to produce a substantially equal amount torque acting on the vanes.

22. The rotary motor according to claim 1, wherein the rotary motor has no side load.

23. The rotary motor according to claim 1, wherein the rotary motor has no secondary nut runner.

24. The rotary motor according to claim 1, wherein the lobes are periodically spaced at a substantially equal distance along an inner circumferential surface of the multi lobe member.

25. A method for manufacturing a rotary motor, comprising:

placing a plurality of vanes in an outer circumferential surface of an inner rotary member;

configuring a plurality of lobes each of which comprises an inlet and an outlet;

circumferentially arranging the lobes in an inner circumferential surface of a multi lobe member;

forming a plurality of chambers wherein each chamber is placed between two adjacent lobes and is surrounded, at least in part, by the inner circumferential surface of the multi lobe member and the outer circumferential surface of the inner rotary member;

surrounding, at least in part, the multi lobe member with an outer port member comprising an inlet port and an outlet port;

forming an inlet groove and an outlet groove on an outer surface of the multi lobe member;

aligning the inlet with the inlet groove and further aligning the inlet groove with the inlet port; and aligning the outlet with the outlet groove and further aligning the outlet groove with the outlet port.

26. The method for manufacturing a rotary motor according to claim 25, further comprising:

configuring the lobes to form a contact with the outer circumferential surface of the inner rotary member;

covering and sealing sides of the outer port member, the multi lobe member, the inner rotary member and the chambers with a plurality of end plates; and configuring the vanes to form a seal between the vanes and the end plates.

27. The method for manufacturing a rotary motor according to claim 25, further comprising:

configuring each of the chambers to maintain a substantially equal volume with respect to each other during rotation of the inner rotary member;

forming a concave portion in each chamber; and configuring each of the chambers to receive a working fluid by way of the inlet located in a nearest neighboring lobe of each of the chambers and to discharge the working fluid by way of the outlet located in another nearest neighboring lobe of each of the chambers in a rotation direction of the inner rotary member.

28. The method for manufacturing a rotary motor according to claim 25, further comprising:

configuring a drive to pass through a central axis of the inner rotary member.

29. The method for manufacturing a rotary motor according to claim 25, further comprising:

configuring the vanes to receive a working fluid via the multi lobe member during rotation of the inner rotary member.

30. The method for manufacturing a rotary motor according to claim 25, further comprising:

configuring the rotary motor to feed a working fluid into all of the inlets and the outlets through the lobes without requiring multiple external connections.

31. The method for manufacturing a rotary motor according to claim 25, further comprising:

configuring the rotary motor to allow rotation of the inner rotary member reversible without repositioning the rotary motor.

32. The method for manufacturing a rotary motor according to claim 25, further comprising:

configuring each of the chambers to produce a substantially equal amount torque acting on the vanes.

33. The method for manufacturing a rotary motor according to claim 25, further comprising:

periodically spacing the lobes at a substantially equal distance along an inner circumferential surface of the multi lobe member.

34. An apparatus for use in a hydraulic torque system, comprising:

rotating means for housing a plurality of torque generating means;

multi lobe means for supplying a working fluid to act on the torque generating means wherein the multi lobe means comprises two or more contacting portions, wherein each of the contacting portions comprises an inlet and an outlet for the working fluid, and wherein at least one of the contacting portions is in contact with at least one of an inner circumferential surface of the rotating means;

a plurality of chamber means for holding the working fluid wherein each of the plurality of the chamber means is surrounded, at least in part, by an inner surface of the multi lobe means and an outer surface of the rotating means, wherein at least one of the plurality of the chamber means is placed between two contacting portions, and wherein each of the plurality of chamber means is configured to maintain a substantially equal volume during rotation of the rotating means;

outer port means for surrounding, at least in part, the multi lobe means; and means for covering and sealing the means for supplying the working fluid and the rotating means, wherein the outer port means comprises an inlet port and an outlet port, wherein the multi lobe means comprises an inlet groove and an outlet groove on an outer circumferential surface of the multi lobe means.

35. The apparatus according to claim 34, further comprising:

a drive to pass through a central axis of the rotating means.

36. The apparatus according to claim 34, wherein the torque generating means are configured to receive the working fluid via on the multi lobe means during rotation of the rotating means.

37. The apparatus according to claim 34, wherein each of the chamber means is configured to produce a substantially equal amount of torque acting on the torque generating means.

38. The apparatus according to claim 34, wherein the contacting portions are periodically spaced at a substantially equal distance along an inner circumferential surface of the multi lobe means.

* * * * *